US005916046A

United States Patent [19]

Allred et al.

[11] Patent Number: 5,916,046

[45] Date of Patent: Jun. 29, 1999

[54] DEVICE FOR PHYSICAL CONDITIONING AND COORDINATION DEVELOPMENT

[76] Inventors: Dale Allred, 15 E. Broad Hollow Dr., Woodland Hills; Vern W. Bangerter, 412 S. 100 East, Salem, both of Utah 84653

[21] Appl. No.: 09/017,558

[22] Filed: Feb. 2, 1998

[51] Int. Cl.[6] ..... A63B 69/00

[52] U.S. Cl. ..... 473/430

[58] Field of Search ..... 473/423, 424, 473/425, 430, 449, 450, FOR 160, 197, 198, 199, 213, 214

[56] References Cited

U.S. PATENT DOCUMENTS

| | | | |
|---|---|---|---|
| 1,753,310 | 4/1930 | Costello | 473/424 |
| 2,697,603 | 12/1954 | Haines . | |
| 2,939,705 | 6/1960 | McCall . | |
| 3,012,781 | 12/1961 | Nelson . | |
| 3,050,305 | 8/1962 | Bachand . | |
| 3,602,504 | 8/1971 | Chapman . | |
| 3,717,342 | 2/1973 | Haney et al. . | |
| 4,161,313 | 7/1979 | Dickey . | |
| 4,296,925 | 10/1981 | Alston . | |
| 4,352,494 | 10/1982 | Wells . | |
| 4,462,599 | 7/1984 | Brown . | |
| 4,621,811 | 11/1986 | Campbell . | |
| 4,687,209 | 8/1987 | Carey | 473/424 |
| 4,948,150 | 8/1990 | Daly, Jr. et al. . | |
| 5,209,713 | 5/1993 | Brown et al. | 482/92 |
| 5,338,026 | 8/1994 | Kregel | 473/430 X |
| 5,417,631 | 5/1995 | Brown et al. | 482/92 |
| 5,516,116 | 5/1996 | Castro . | |
| 5,586,760 | 12/1996 | Hauter . | |

*Primary Examiner*—William H. Grieb
*Attorney, Agent, or Firm*—Madson & Metcalf

[57] ABSTRACT

The disclosed invention is a means of physical training in the area of developing explosive leg power and improving hand to eye coordination. The invention is comprised of a tethered ball or other object which is attached to a tether, the tether being mounted to a supportive structure. The object can, in some variations, be adjusted according to various heights or distance away from the supportive structure. The user typically jumps up and interacts with the object (ball) to perform a variety of skill functions such as basketball "tip-ins" or "rebounds". The tether limits the displacement of the object from the supportive member, which in the case of basketball would likely be a basketball goal. Many times the tether includes an elastic component that stores energy when the object is displaced by the user. The object, when released, will then react in a ballistic manner necessitating repeated jumps of the user to again grasp the object while incorporating and thus developing hand to eye coordination and physical condition of the user, while also increasing the sport-specific skill of the user.

16 Claims, 5 Drawing Sheets

DEVICE FOR PHYSICAL CONDITIONING AND COORDINATION DEVELOPMENT

BACKGROUND OF THE INVENTION

1. Field of the Invention

The invention herein relates to a device and method of increasing the user's jumping ability and hand to eye coordination associated with jumping, and more particularly to a jump training device and method of training in association with ball sports such as basketball.

2. Overview of Prior Art

Devices that encourage individuals to jump, in an effort to increase the vertical jump height and hand to eye coordination have been attempted over the years. The sport of basketball for example has become increasingly more popular and therefore more competitive, thus setting the stage for more useful training devices. A very basic device such as is disclosed by Haines in U.S. Pat. No. 2,697,603 is a simulated standard with a cantilevered arm that supports a ball on a tether. Here the ball does have a height adjustment to accommodate different height and skill levels of individuals but the ball moves with the standard, maintaining the ball in a flexible but non-retracting state. The disclosed standard would be incapable of properly supporting a ball that is grasped and not simply touched or tipped. This coordinated grasping and rebounding is a critical aspect of the game of basketball and clearly not capable of being simulated with this device.

In contrast, McCall, Jr. in U.S. Pat. No. 2,939,705 disclosed a basketball training device that is adjustable to various heights and allows a user to jump and rebound a ball, but the ball must then be reloaded. No recoiling device is included. The device is also large and cumbersome making it practical only for institutional use.

Nelson disclosed a recoil system in U.S. Pat. No. 3,012,781 but here the ball is tethered by a cable which is suspended from a pivotally mounted, spring loaded arm. The device must be mounted to a wall or other supporting surface, which again limits the usage to institutional use. Also here the inertia of the long arm would give an unnatural slack to the tether at the end of the movement. This "easing up" of tension could adversely affect the individual's coordination and timing in a real world game situation.

A recoiling tether was disclosed by Bachand et al in U.S. Pat No. 3,050,305. Here a spring tensioned wheel and the spring has to be wound up to produce adequate tension to keep the ball in a recoiled position. There are two major problems. First the constant force of the tension spring, even at rest, to ensure the system is tight would degrade the spring constant of the spring, forcing the user to periodically go through the arduous task of disassembly to replace the part. Second the tracking of the cable onto the spool is not provided for and given the ballistic nature of the activity, the device could easily not track on the spool which would make the device inoperable.

Brown disclosed a soccer practice device in U.S. Pat. No. 4,462,599 in which the ball is suspended by a tethered rope. The purpose of the device is to position the ball to be kicked by the user, therefore a recoil feature would be clearly not anticipated because it would make the device non-funtional. The ball is intended to be suspended and gravity eventually causes it to reposition itself.

A physical training device was disclosed by Wells in U.S. Pat. No. 4,352,494 in which a ball-like object is attached to the end of a boom with two rotatably mounted joints.

Articulation of these two joints enables the ball to be actively displaced in an upward direction and laterally toward and away from the base support. The excessive manufacturing cost and logic controls necessary to run the mechanisms that drive the joints are far beyond what a consumer or even many institutions could realistically attain.

An adjustable height trainer with a basketball backboard was disclosed in U.S. Pat. No. 4,296,925 by Alston. Here the ball is tethered to a weighted counter balance to retract the ball after it is displaced and released and the entire assembly is adjustable for height by use of a cable and crank assembly. Though some of the problems of the previously mentioned art are addressed, it by no means solves every shortcoming. As before, the massive structure of the device precludes most individuals from possessing a device of their own either as a cost issue or due to limited space requirements. The device as disclosed shows the backboard to be non-functional since all of the action of the ball takes place below the board. This makes tip-ins and rebounds at the rim impossible to practice on this device. Also the weighted counter balance adds unwanted inertia as described in the Nelson patent.

Brown et al. in U.S. Pat. Nos. 5,209,713 and 5,417,631 disclosed a training device similar in function to Bachand et al, with the addition of a frame structure that is to be mounted to a supportive surface. A coil spring or counter weight causes automatic retraction of a tethered ball which is suspended for the user to jump, retrieve and release and repeat. The height of the device is indicated enabling quantitative representation of successful attempts by the user. As a similar theme, the structure and mounting method of the device is clearly intended for use by an institution where space and financial expenditure are of less of a concern than to an individual, small school or recreation center. In addition the same problems exist as before in the method of retrieval of the ball in sofar as the inertial qualities of the system. As well, this disclosure does not include a backboard and rim assembly, nor is it obvious how such a device would be used in conjunction therewith.

A unique device was disclosed by Haney et al in U.S. Pat. No. 3,717,342 where a suspended tethered ball is supported by a boom that is pivotally mounted to a supportive surface. The ball is anchored by a counterbalance weight that has an adjustable starting height. The height of the ball is altered by vertically moving the weight, thus pulling in or letting out the tether. The arm is claimed to be locked in place, not free to move which would add more real-game skill simulation to the exercise. The method of recoil is weight with a frictional element added to dampen the movement of the ball. This only adds to the unrealistic and awkward movement of the weighted recoil as has been previously disclosed. Also the height adjustment requires the movement of a large cylinder that is secured in place by a clamping means. This adjustment would be cumbersome, especially where a variety of players were being trained together and necessitated repetitive adjustment and recall of specific positions.

Though the device could conceivably be manufacturable such that it could be potentially affordable to those other than elite institutions, the device requires mounting to a wall which in most cases precludes usage with a basketball backboard and rim. This is essential to the importance of training to simulate a game type situation.

Another disclosure that uses a boom type device to support a ball is that of Campbell in U.S. Pat. No. 4,621,811 wherein a basketball training device is shown and described that more closely simulates a game condition. Here a tethered ball is mounted above a basketball rim and the end of the tether is accessible to a trainer or coach. The tether is capable of being pulled to move the ball in a manner that is not predictable to the user or users which are attempting to put the ball in the basket. Though the device is creative and potentially useful, it has some drawbacks. First of all, it requires a person to control the tether. Without this the erratic movement of the ball is lost, thus removing the game-like similarity. Secondly, it is true that the device is simpler than much of the prior art, but nevertheless it is still a large and cumbersome method of performing such a simple task.

Another boom device that is intended to assist a user with developing skill in the area of basketball handling is that if Dickey in U.S. Pat. No. 4,161,313. Here a boom releasably supports a basketball in a position above a basketball rim. The means of releasable attachment include a cap made to receive a ball of a specific size, the cap and ball combination including a hook and loop type fastener or a magnetic fastening means. This is only minimally functional because the ball is stationary as the user jumps to grasp it. In a game-like condition, the ball is always dynamic when above the rim. The ball needs to be in motion and preferably somewhat unpredictable to the user. This device does not offer such a function.

Daly, Jr. et al., in U.S. Pat. No. 4,948,150 also offers a boom for supporting a tethered ball. This discloses a volleyball supported above a net to simulate the set position for spiking the ball. As before, the airborne ball is dynamic. One of the challenges to the user is to develop proper timing of the user's jump and body position relative to the ball's position. This device does not allow that to be simulated.

Other tethered ball practice devices include that of Chapman and Robinson in U. S. Pat. No. 3,602,504 in which a game device is disclosed that includes a standard with a target and a traditional basketball goal or other multiple games. The target is opposed to the goal and a net is mounted above and there between. The ball is suspended there below and clearly not intended to be an accurate simulation of a basketball game. In fact, the tethered ball can not be easily used with the device because the tether would become entangled with the target or goal.

A traditional tethered ball device is disclosed by Castro in U.S. Pat. No. 5,516,116, the modification being in the assembly to which the tether attaches to the vertical support member. This assembly cam be positioned along the vertical support member allowing for a variety of activities and sizes of individuals. It would not be obvious to incorporate an existing basketball standard with this device, nor does the disclosure suggest the cord to include elastic properties.

A soccer training device is disclosed by Hauter in U.S. Pat. No. 5,586,760 in which a soccer ball is provided in a mesh net and a cord connecting it to a waist belt that is appropriately worn around the waist of the user. This allows the ball to be tethered to the user so that as the soccer ball is kicked, minimal time is required to chase the ball in order to kick it again. The cord is claimed to be made of a non-elastic material and even though it would not be considered obvious to fasten the waist belt around a basketball rim or other support member, the non-elastic nature of the cord would not allow the device to function in the form of a dynamic game simulation as in the game of basketball. With these points in mind, all of the disclosed art fall short in terms of a challenging, game realistic, easily adjustable and inexpensive training device.

SUMMARY OF THE INVENTION

The object of the disclosed invention is to provide a means of athletic training which offers a greater degree of sport-specific challenge than offered by existing devices. The sport-specific nature as disclosed herein relates to basketball training but could also apply to other sports in which jumping ability is advantageous, especially where a ball is also incorporated into the play, such as in the case with volleyball and soccer. Here the basketball training device is capable of fastening to an existing basketball standard and enables placement of a tethered ball on or near the rim of the basket. The tether may include a recoil mechanism which is an elastic means to recoil the ball upon releasing it after an individual jumps up, grasps the ball and pulls it down, as would simulate a rebound in a game situation. This elastic component provides a dynamic, game-realistic aspect to the use of the device in that the suspended object is moving radically as it would if free and several individuals jumped to grab and knock it, each trying to rebound the ball as in a game. An elongated tether can also be used to restrict the range of the ball such as would be desirable with children playing near a street. The method of fastening the ball to the rim includes a closed loop of material that fastens over and through the rim thereby allowing the object or ball to freely travel through the rim and net.

DETAILED DESCRIPTION OF THE PREFERRED EMBODIMENT

Figure 1:
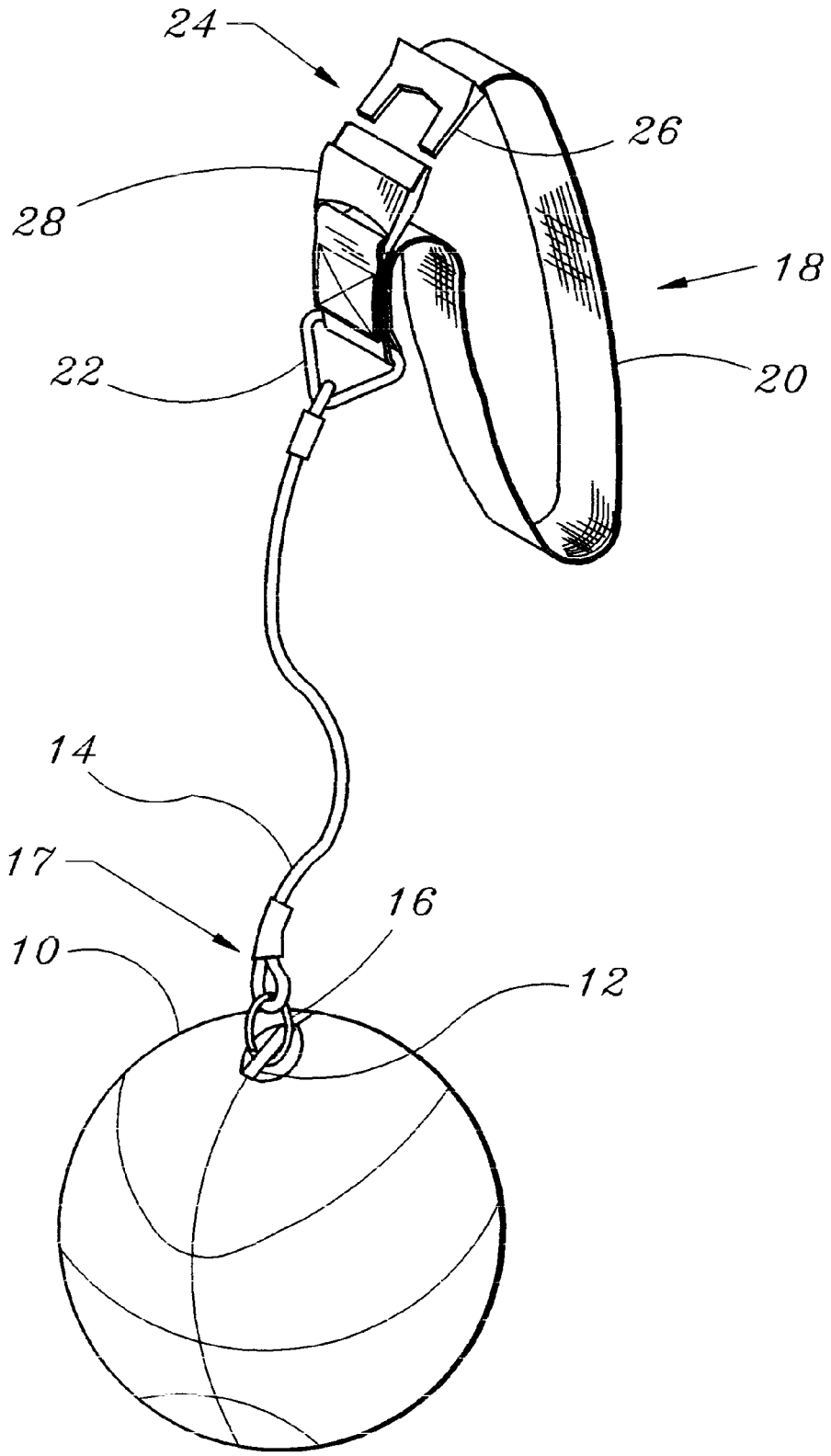
FIG. 1 is an isometric view of a training device produced in accordance with the preferred embodiment of the present invention.

Physical training through jump height training and hand to eye coordination has value in a variety of sports and in general physical fitness. When the attention is turned to more specific sports, such as basketball, a more sport specific type of training is widely accepted as being most effective. As such, jump training with regard to the sport of basketball, is of greatest value when the player is motivated to interact with, or in close physical proximity with a basketball backboard and rim. The disclosed invention allows this to happen and is shown alone in FIG. 1, without attachment to a supportive structure such as a basketball goal.

Here a physical training device is shown in a preferred embodiment, in which the device includes an object, in this case is a basketball 10 and a receiver 12 secured to the basketball 10. A longitudinal tether 14 has one end secured to the receiver 12 by use of a clip 16. This clip 16 is preferably of a variety that is detachable from the receiver 12. The invention could also function without this clip 16 in that the tether 14 could attach directly to the receiver 12. In doing so versatility and ease of replacement are sacrificed for reduction in cost. Therefore the preferred embodiment is disclosed with the clip 16.

The loop 17 at the end of the tether 14 is shown to be the most efficient method of allowing for attachment of the basketball 10 to the tether 14, The specifics of the loop 17 are not integral to the function of the invention nor even the existence of the loop 17 itself. An eye bolt secured to the end of the tether 14 has been determined by the inventors to be the most effective means of providing said loop 17, but the inventors acknowledge that an infinite amount of variations of this arrangement would also function in a similar manner.

In the preferred embodiment, the longitudinal tether 14 is elastic in nature thereby acts as a spring. This is most likely accomplished by manufacturing the tether 14 from a material with elastic properties. Such materials include natural rubber, latex, polyurethane (elastromeric polymers) or even spring steel (metallic matarials). With spring steel the tether would most likely be comprised of a coil extension spring. The other end of the tether is secured to a cord loop 18.

The cord loop 18 is comprised of a pliable strap 20 which is likely manufactured from a material such as cotton or nylon natural or synthetic woven materials, respectively. The cord loop 18 is secured to the tether 14 by use of a ring 22. The cord loop 18 is shown here to be adjustable in length and with at least one end being functionally detachable from the ring 22. One such method of accomplishing both features disclosed herein by use of a buckle 24. The buckle 24 is comprised of a male portion 26 which can be releasable secured into a female portion 28. Here the male portion 26 allows the strap 20 to be received thereby and secured at various positions, thus varying the dimension of the cord loop 18. This detachability also allows the device to be secured around enclosed objects of varying dimensions.

A variation may include (e.g.14, 36, 44, 48) an extension means that would be located in series with the tether 14. The series arrangement may connect either between the clip 16 and the loop 17, or between the other end of the tether 14 and the ring 22. Since the former is predicated toward detachment, this would be the most likely position, though either position would not affect the function of the invention. Addition of the extension means in this way would allow the elastic properties of the tether 14 to be utilized while enabling the distance from the ball 10 and the cord loop 18 to be varied, thus increasing the versatility of the invention according to the skill and abilities of the user. This extension means is most likely comprised of a rope which is manufactured of a pliable material, thereby allowing smooth motion of the ball 10 in accordance with the elastic nature of the tether 14.

Figure 2:
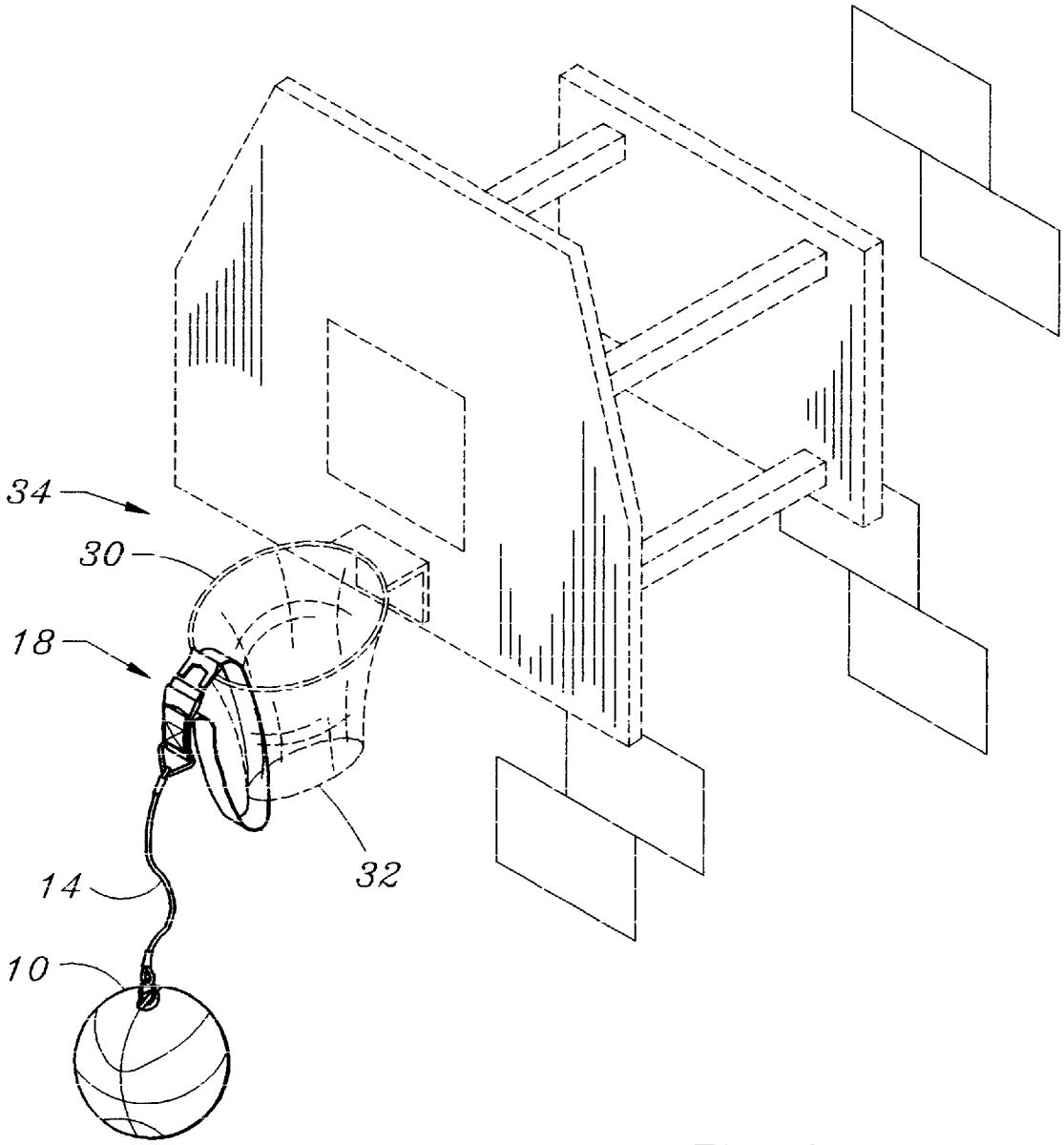
FIG. 2 is an isometric view of a training device shown mounted on a basketball standard, the training device produced in accordance with the preferred embodiment of the present invention.

A typical use of the disclosed invention is further shown in FIG. 2. Here the invention is shown with cord loop 18 fastened around a basketball rim 30 and net 32. The tether 14, intended here to be elastic in nature, provides for ballistic movement of the ball 10. The attachment means of the cord loop 18, as shown here, also provides the ball 10 to be shot or laid up into the basket without tangling of the invention. The ballistic movement of the ball 10 due to the elastic nature of the tether 14 provides both a stimulating physical exercise to the user and also develops the skill level of the user in the rebounding of a ball simulating a game like situation.

Since the tether 14 limits the distance the ball 10 can be positioned away from the basket 34 the ball is always in close proximity thereto, thus eliminating wasted time of chasing a loose ball. This chasing is not only unproductive time for the user in training but this time gap provides rest to the user that is unavoidable and detracts from maintaining an elevated heart rate of the user necessary to accomplish optimal physical conditioning.

The tether 14 may also be non-elastic in nature and may be adjustable in length. This adjustability can be accomplished in a variety of ways, and the method used is not important to the novelty and function of the invention. The most practical method would be utilizing a clasp that is capable of receiving one end of the tether 14 and securing it thereto at a variety of lengths, similar to that previously disclosed with the strap 20 and the buckle 24 on the cord loop 18. This variation in lengths of the tether 14 enables users of various heights and skill levels to use the invention and allows shooting practice to take place without chasing the ball into potentially dangerous situations such as with a child and a nearby street.

Figure 3:
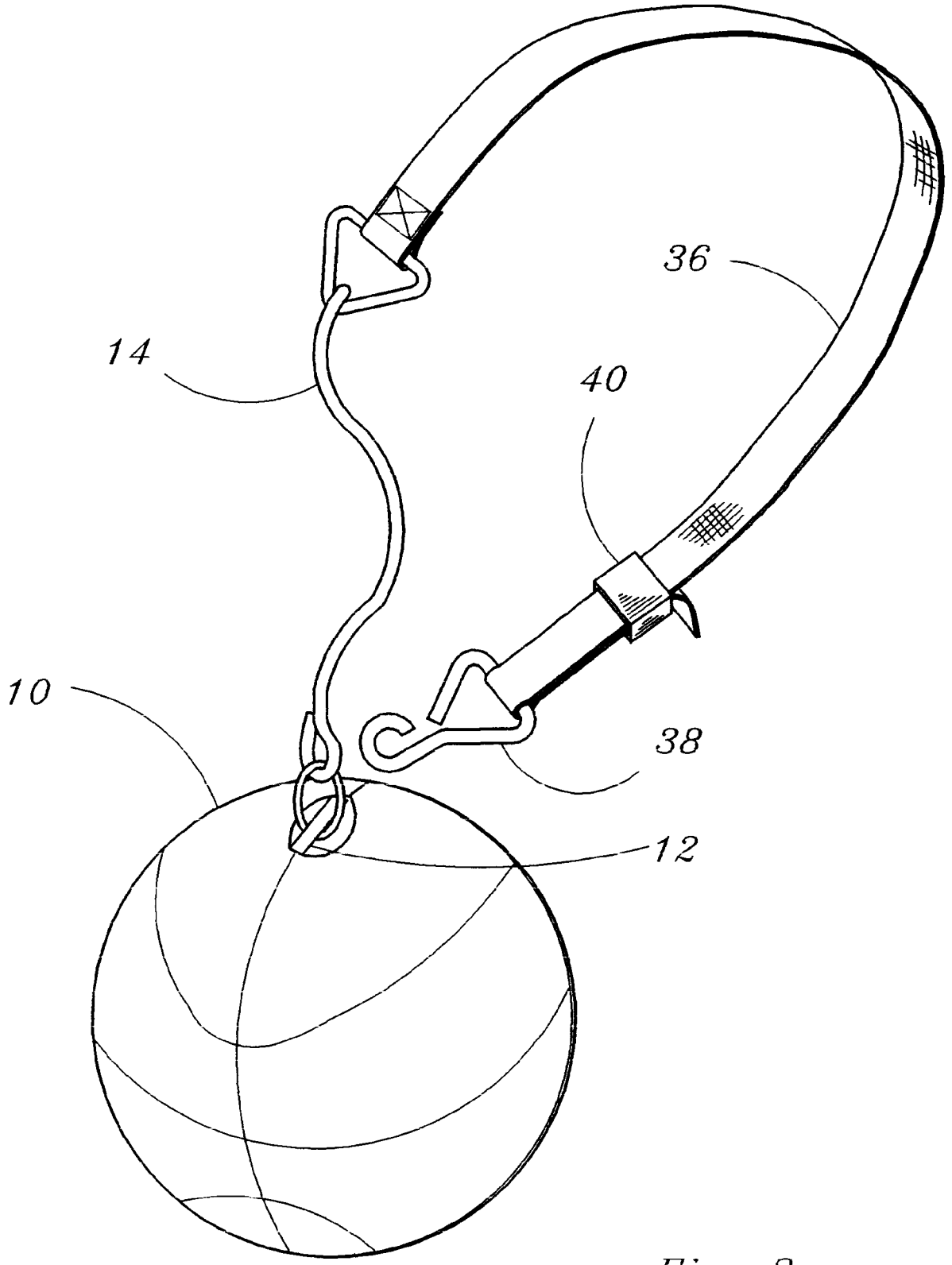
FIG. 3 is an isometric view of an alternative to the preferred embodiment to the training device shown with a length adjustment.

An alternative to the preferred embodiment is shown in FIG. 3. Here the object or ball 10 remains the same with the tether 14 attached to the ball 10 by use of a receiver 12. The tether 14 is fastened to a cord member 36 which is in turn releasably secured to the receiver 12 on the ball 10. The cord member 36 is secured to the receiver 12 by use of a clip hook 38 which receives the cord member 36 the free end being secured to the base of the cord member 36 by use of a cord clip 40. This combination provides a potentially large loop to fasten around an object while the tether 14 may provide elastic energy to ballisticly move the ball 10.

Figure 4:
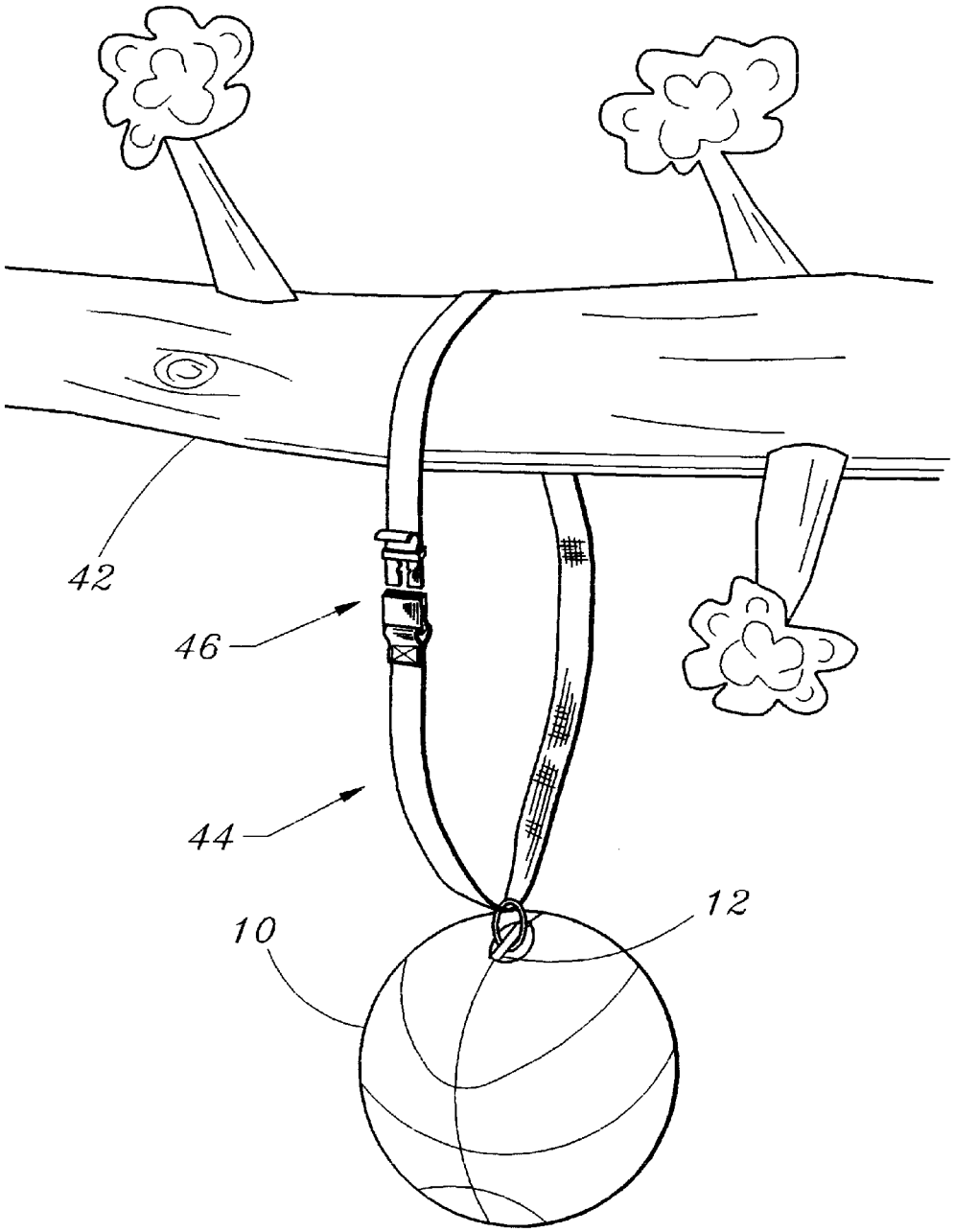
FIG. 4 is an isometric view of a second alternative to the preferred embodiment to the training device shown mounted on a tree branch as a supportive member.

A second alternative to the preferred embodiment is shown in FIG. 4, the invention being secured around the branch of a tree 42. Here as before, the object or ball 10 and the receiver 12 function similar to that previously disclosed. The variation is that a clasping tether 44 is used. This can be elastic in nature or simply manufactured of a pliable material as previously disclosed with the pliable strap (item 20 in FIG. 1). The clasping portion of the clasping tether 44 is accomplished by use of a buckle 46 which allows the tether to be opened to place it around an object such as the tree 42 shown here. As before, the buckle 46 can also provide for adjustment of the length of the tether to vary the suspended resting height of the ball 10.

The loop created by the tether 44 in this arrangement can be in direct communication with the receiver 12 on the ball 10, thus eliminating any need for a clip (item 16 in FIG. 1). This assembly is not limited to this variation and could therefore be incorporated into the other variations disclosed of this invention. Either method does not inhibit the function of the invention.

Figure 5:
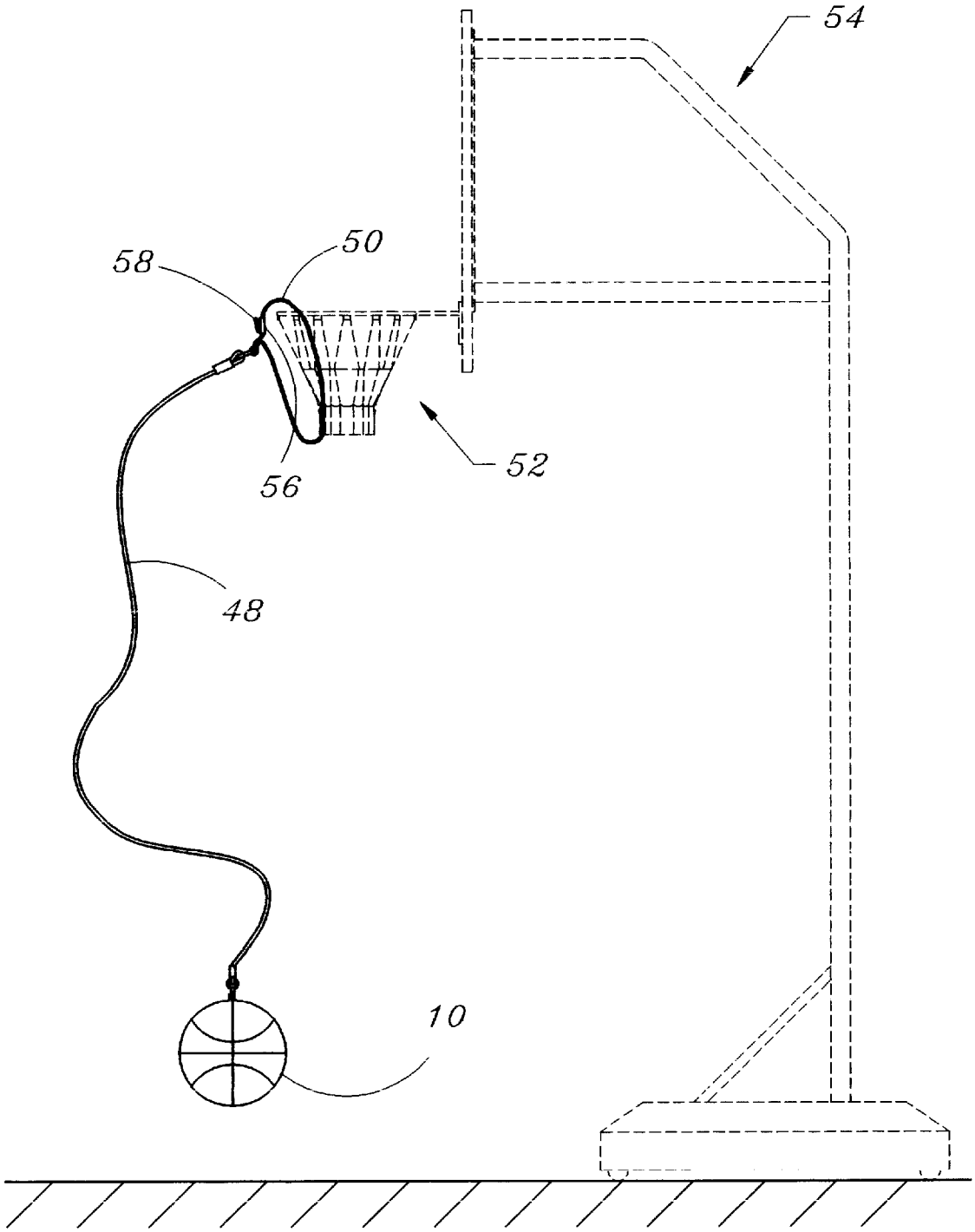
FIG. 5 is a side view of a variation to the preferred embodiment to the training device shown with an elongated tether, the device being fastened through the rim and net of a basketball standard.

Another variation of the invention is shown in FIG. 5. In this case the ball 10 is attached to one end of a tether line 48 and the other end is attached to cord loop strap 50. This strap 50 functions in the same manner as the cord loop ( item #18 in FIGS. 1 and 2) in that it passes around an object, in this case, the rim and net 52 of a basketball standard 54. The purpose of this design is, as before, to allow the ball 10 and tether line 48 to pass freely through this standard hoop and net 52 and return to its starting position without tangling or requiring a special rim. The buckle mechanism 56 shown here is, as before, not integral to the performance of the invention, and another alternative is disclosed in this ladder type buckle where the free end of the strap 58 is received by the buckle and is folded back onto itself, thereby securing it into position. All of the buckles disclosed in this disclosure are interchangeable in function and other buckles not disclosed herein are intended to be included in principle.

The tether line 48, which is attached to the loop strap 50, is optimally found to be 8 to 10 feet in length and may or may not be elastic in nature. The primary purpose of this tether line 48 is to allow a limiting range of movement of the ball 10, again so that physical training can be accomplished without the need for another individual. This is especially helpful in eliminating the need to chase after a ball that is the result of a missed shot and is even more apparent when the shooter is a child and the potential exists for the child to run into a dangerous area such as a street to retrieve a ball.

The ball as disclosed herein has been shown to be an inflatable ball and particularly a basketball, but other types of balls such as a soccer ball, volleyball and a football would all be equally advantageous. Other objects that do not include inflatable balls would also function in that an object is used that can be easily grasped and released by the user.

Inflatable balls are desirable because of their direct application to a particular sport and they are typically lightweight and impact absorbent, thus reducing injury if the object struck the user in a sensitive area such as the head.

What is claimed is:

1. A device for use with a goal having a hoop serving as a target for receiving a ball, the device comprising:

a ball;

a tether having first and second ends, the tether being connected proximate a first end to the ball; and a loop secured to the second end of the tether and configured to extend through a hoop, the second end and the loop being readily movable with respect thereto in a first direction and substantially restrained with respect thereto in a second direction, the loop sized to follow the tether and ball through a hoop in the first direction and configured to restrain the tether and ball in proximity thereto in the second direction.

2. The device of claim 1, wherein the loop is configured to follow the tether through a hoop an arbitrary number of times.

3. The device of claim 1, wherein the tether is resilient.

4. The device of claim 3, wherein the tether is formed of an elastomeric material.

5. The device of claim 3, wherein the tether is formed of a metallic material.

6. The device of claim 1, wherein the ball is a sports ball.

7. The device of claim 6, wherein the ball is selected from the group consisting of basketballs, footballs, soccer balls, volleyballs, and baseballs.

8. The device of claim 1, wherein the loop is formed of a material having a comparatively low coefficient of friction with respect to a hoop, for enhancing sliding therebetween.

9. The device of claim 8, wherein the loop is formed of a material selected from the group consisting of woven and non-woven synthetic polymers.

10. The device of claim 1, wherein the tether has a length corresponding thereto, the length being selectable by a user.

11. The device of claim 1, wherein the loop has a loop length associated therewith and measurable in the second direction, the loop length being selectively adjustable by a user.

12. The device of claim 1, wherein the loop is selectively attachable and removable, by a user, with respect to a hoop.

13. The device of claim 1, wherein the tether has a size and elasticity associated therewith, the size and elasticity being selected to be effective to resist movement of the ball and first end of the tether away from a hoop by a user.

14. The device of claim 13, wherein the size comprises a length and a second dimension transverse thereto.

15. The device of claim 13, wherein the ball is substantially a basketball, the loop is sized to move in the first direction through a hoop corresponding to a basketball goal. and wherein the tether is configured to move the ball in a manner selected to simulate rebounding actions of a basketball about a basketball goal.

16. The device of claim 1, wherein the tether is sized to correspond to a skill and size of a user.

* * * * *